United States Patent [19]

Chikatani

[11] Patent Number: 4,554,776

[45] Date of Patent: Nov. 26, 1985

[54] PACKAGE BAG BINDING APPARATUS

[75] Inventor: Hajime Chikatani, Hachioji, Japan

[73] Assignee: Kabushiki Kaisha Daisei Kikai, Tokyo, Japan

[21] Appl. No.: 467,172

[22] Filed: Feb. 16, 1983

[30] Foreign Application Priority Data

Feb. 19, 1982 [JP] Japan ..... 57-25657
Aug. 7, 1982 [JP] Japan ..... 57-137543

[51] Int. Cl.[4] ..... B65B 57/00

[52] U.S. Cl. ..... 53/76; 53/138 A; 53/583

[58] Field of Search ..... 53/76, 137, 138 A, 371, 53/372, 583

[56] References Cited

U.S. PATENT DOCUMENTS 3,775,937 12/1973 Devan et al. ..... 53/137

4,328,654 5/1982 Van Ginkel et al. ..... 53/138 A

*Primary Examiner*—Francis S. Husar
*Assistant Examiner*—Jorji M. Griffin
*Attorney, Agent, or Firm*—Oblon, Fisher, Spivak, McClelland & Maier

[57] ABSTRACT

Disclosed is a package bag binding apparatus for binding openings of package bags filled with packages. A binding device is vertically movably mounted on a frame above a conveyor which conveys filled package bags to a position below the binding device. A detector detects the filling level of the package bags and moves the binding device to the proper vertical level for binding the openings of the bags so that fillings are not sandwiched in the bound place. In one embodiment, the binding device is initially raised to a lifted position and is lowered to a binding position detected by the detector.

2 Claims, 8 Drawing Figures

PACKAGE BAG BINDING APPARATUS

OBJECT OF THE INVENTION

The present invention relates to a package bag binding apparatus for puckering and binding the opening of a bag filled with packages.

BACKGROUND OF THE INVENTION

A conventional apparatus for binding the opening of a package bag has hitherto adopted means to convey a bag filled with packages to a binding device, while gripping its opening, and to bind the puckered opening always at a predetermined position by the binding device.

In case bulky packages are charged in a bag, therefore, binding of the bag is often completed with a part of the packages caught in its opening, because binding is carried out always at a given position even if the packages are positioned too high in the bag. Namely, a conventional apparatus has such defects as mentioned above, with a resulting problem of damaging the merchandise value of a packaged articles.

SUMMARY OF THE INVENTION

The present invention is intended to provide a package bag binding apparatus in which a bag filling level detector is adopted for detecting the filling level of packages in a package bag filled therewith, and the vertical position of a binding machine is changed in response to the filling level in each bag so as to carry out binding at a desired position, whereby defects in such a conventional apparatus as mentioned before are avoided.

BRIEF DESCRIPTION OF THE DRAWINGS

FIGS. 3 to 5 show the second embodiment of a binding apparatus according to the present invention, wherein FIG. 3 is a front elevation of the second embodiment, FIG. 4 is a side elevation thereof and FIG. 5 is a view showing the portion of a mechanism effecting the ascent of its binding device and a given extent of its descent.

DETAILED DESCRIPTION OF THE PREFERRED EMBODIMENTS

Figure 2:
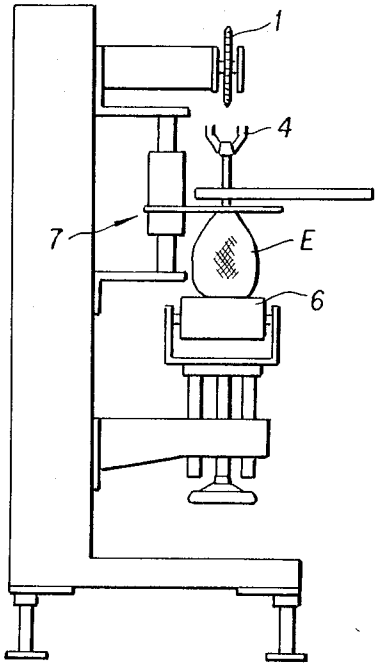
FIG. 1 and FIG. 2 show the first embodiment of a package bag binding apparatus according to the present invention, wherein the former is a front elevation and the latter is a side elevation.
Figure 1:
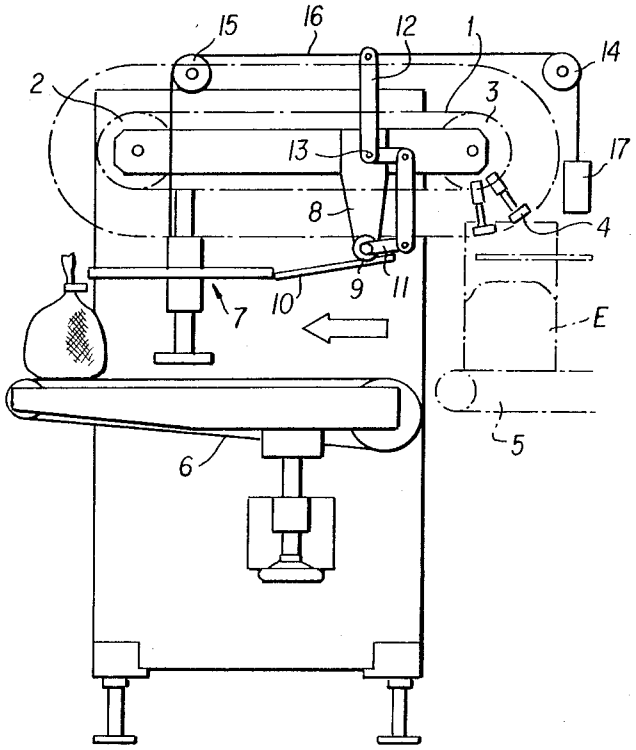

In FIG. 1 and FIG. 2, the reference numeral 1 represents an endless chain stretched over chain wheels 2, 3, and the endless chain 1 has a series of clips 4 attached thereon for gripping the opening of each bag filled with fillings.

Conveyor belts 5, 6 which carry and convey the bags filled with fillings are arranged below the clips. The reference numeral 7 is a binding machine arranged under the endless chain 1, whose structure in detail is not explained here, because it has no direct relation with the present invention. There may be adopted a binding machine of the type described in the invention, entitled "Binding Apparatus for Packing", according to the Japanese application for patent Application No. 25656/1982 and U.S. patent application Ser. No. 467,173 (filed Feb. 16, 1983) under the name of the present applicant. The binding machine 7 is arranged adjustably in its vertical position. The binding machine 7 acts to pucker the opening of a filled bag that is being conveyed, and to bind its opening by winding an adhesive tape therearound or by other ways.

The reference numeral 8 represents a support mounted on a machine frame. A pin 9 is pivoted at the lower end of the support 8, and bag filling level detection bars 10 are fitted on the same pin 9. A lever 11 is fitted on the pin 9. On the other hand, a lever 12 is pivotally secured on the support 8 by a pin 13, and the lower end of said lever 12 is pivotally secured on the end of said lever 11.

Two pulleys 14, 15 are pivotally secured on the machine frame proper, a wire 16 is stretched over the pulleys 14, 15, and one end of said wire has a weight 17 fixed thereon and the other end is connected with the binding machine 7. The weight 17 and the binding machine 7 are mutually balanced in weight so that the binding machine 7 can be moved up and down, even if the wire 16 is given a small force.

The upper end of said lever 12 is fixed on the wire 16.

After the bags filled which packages have been carried and conveyed by the belt conveyor 5, in the above-mentioned apparatus, the series of said clips 4 attached on the chain 1, which are being moved by the same chain, convey the bags to the left direction of FIG. 1, while gripping their openings.

Since the tops of the bags suspended from the clips 4 are caught from both sides by the bag filling level detection bars 10 during that conveyance, the detection bars 10 are pushed up and their inclination is changed when the height of the packages put in the bag is higher than the lower end of the detection bars 10.

The displacement of the detection bars 10 causes the pin 9 to rotate, that rotation causes the lever 11 to turn round the pin 9 and this motion causes the lever 12 to turn round the pin 13.

After the lever 12 is turned, the wire 16 is moved to the right so that the binding machine 7 is displaced upward by an extent corresponding to the rotation of lever 12.

When the level of the packages reaches a higher position than the preset binding position in the bag E, therefore, the binding machine 7 is pulled up in accordance with that level. There is, accordingly, not caused to happen such a state that the bag is bound at a portion of the bag where the packages are sandwiched.

The bag E bound by the binding machine 7 is then discharged to the left by the belt conveyor 6.

In the above embodiment, there is used a system of transmitting the motion of the detection bars 10 to the binding machine by means of the levers in order to move the binding machine up and down. Needless to say, there may be adopted, for example, another proper arrangement of actuating an oil-hydraulic mechanism by the motion of the detection bars 10 so as to move the binding machine up and down, without setting a limit on the system.

In addition, there may be also adopted known proper devices as the binding machine 7. It is essential, in short, to arrange a binding machine so that it can be moved up and down by the displacement of the detection bars 10.

The apparatus concretely described above has detection bars pivotally secured with a downward gradient in the conveying direction along the conveying locus of a conveyor device for conveying bags filled with packages, with gripping their opening, whose inclination is changed by the bag filling level when touched by the conveyed bag, wherein the vertical position of a package bag binding machine is changed in response to the inclination of said detecton bars. When a package bag in which packages are put over a level previously set as a binding height has come, therefore the position of the binding machine is raised in response to that level. There is not, therefore, caused to happen such a state that the bag is bound, and the packages are sandwiched, as in a conventional apparatus.

Furthermore, the apparatus according to the present invention can be put into practice at low cost, because it is very simple in structure, wherein the filling level is detected by the detection bars and the binding machine is moved up and down by the displacement of the detection bars.

The apparatus according to the first embodiment described above is of a binding apparatus in which the filling level of a bag filled with packages is detected by a detecting device, and a binding device is controlled to move up and down in response to the detected filling level so that the postion corresponding to the detected filling level is bound.

However, the adoption of such a construction needs a complicated fluid control device or the like for controlling the vertical position of the binding device in response to the detection signals generated by the detecting device, and especially a fluid control device which must be adopted to position the binding device in response to the detected level, with good responsiveness.

Another embodiment, which will be described below, is intended to provide a binding apparatus having a simple composition in which the position responding to the filling level in a package bag can be bound, with no need of such a control device.

Figure 4:
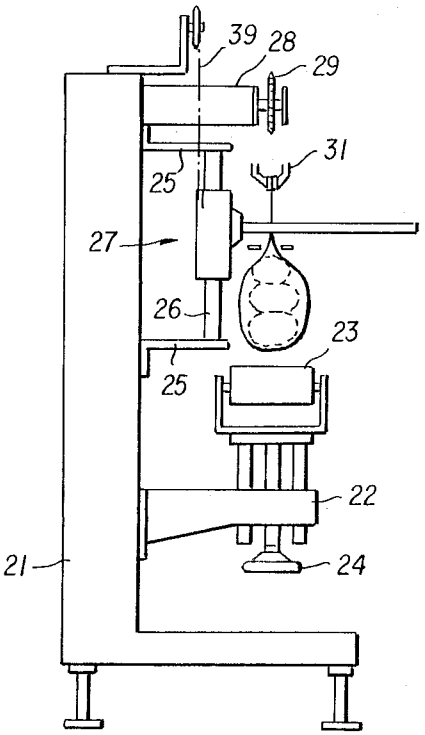
Figure 3:
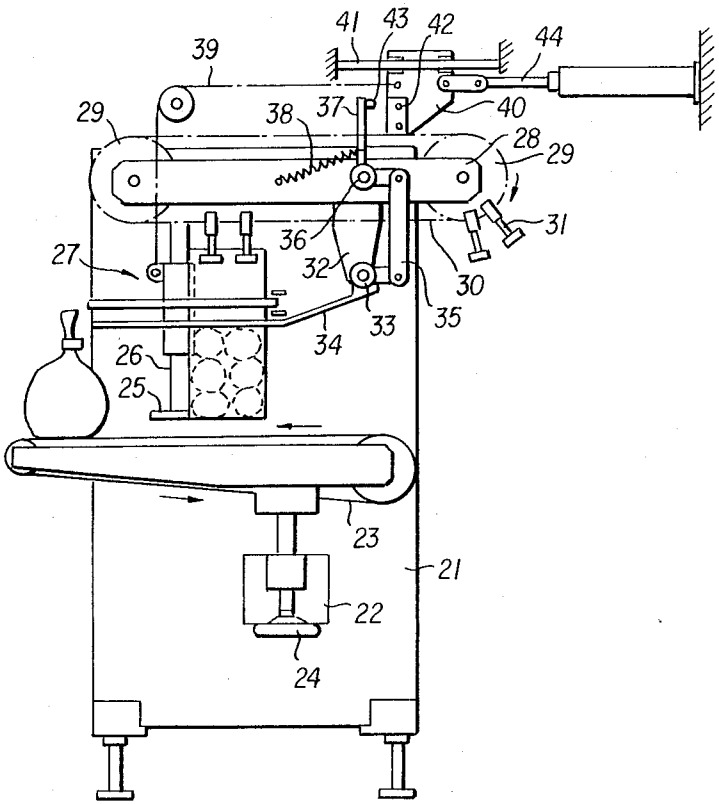

In FIG. 3 and FIG. 4, the reference numeral 21 represents a machine frame, a support frame 22 is mounted on the machine frame 21, and a package bag-conveying conveyor 23 which has an endless belt is supported on the support frame 22 so that its vertical position can be adjusted.

The reference numeral 24 is a handle for adjusting the vertical position of the package bag-conveying conveyor 23.

The machine frame 21 has other support frames 25 mounted thereon, and a guide bar 26 is vertically supported between said support frames 25.

On the guide bar 26, a binding device 27 is supported so that it can be vertically displaced along said guide bar 26.

A third support frame 28 is also mounted on the machine frame 21, two chain wheels 29 are provided at an interval on said support frame 28, and an endless chain 30 is stretched over the chain wheels 29.

The endless chain 30 has a plurality of clips 31 attached thereon for gripping the openings of package bags and conveying them.

The explanation in details of the conveyance of the bags by these clips 31 can be found in the Japanese application for a patent filed under the name of the present applicant, and having Application No. 25657/1982.

In addition, the structure of the binding device 27 itself is not critical to the present invention, whose explanation in detail will be therefore omitted. There may be adopted a binding device of the type described in the Japanese application for patent, Application No. 25656/1982, entitled "Binding Apparatus for Packing", filed under the name of the present applicant, or the like. Also, there may be properly adopted a device of puckering the opening of a filled bag, and binding the opening by winding an adhesive tape therearound, or by another way, for example, binding with a metal fitting or winding a wire material.

On the other hand, a bracket 32 is mounted on the machine frame 21, said bracket 32 having detection bars 34 pivotally secured thereon by a pin 33, for detecting the filling level of the filled bag. The detection bars 34 are turned round the pin 33 in response to the filling level when touched by the bag, whereby the filling level is detected.

The turning of the detection bars 34 around the pin 33 is transmitted to a contact bar 37 pivotally secured on the pin 36 by way of a link 35, so as to turn the contact bar 37 round the pin 36.

The contact bar 37 is pulled counterclockwise by a spring 38, thereby to force the filling level detection bars 34 in the direction that they are turned counterclockwise.

One end of a wire 39 is connected with the binding machine 27 and the other end thereof is fixed on a sliding plate 40. The sliding plate 40 is supported slidably along a guide 41.

The sliding plate 40 has a micro switch 42 fitted thereon, and its contact 43 is placed at a position where it will touch on the above-mentioned contact bar 37. The piston 44 of an air cylinder is secured on the sliding plate 40.

The operation of the package bag binding apparatus described above will now be explained.

Figure 5:
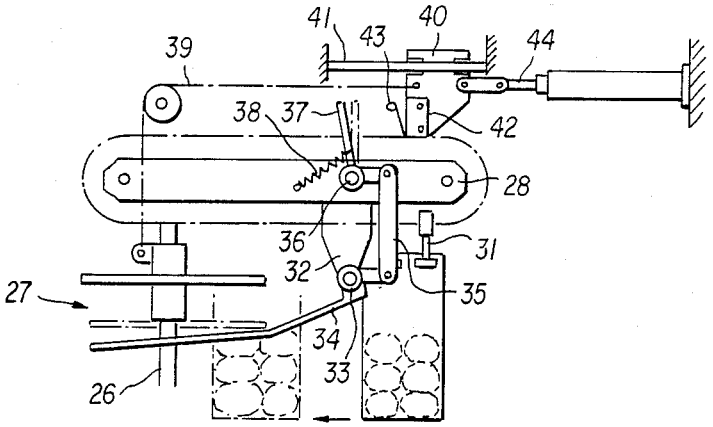

The endless chain 30 is moved around the chain wheels 29 in the arrow direction shown in the drawings, and the clips 31 attached on said endless chain 30 convey the package bags, while gripping their openings, as shown in FIG. 5.

A given quantity of fillings are charged into the bag halfway in this conveyance. When the bag filled with articles has been further conveyed, the bag touches on the filling level detection bars 34 and displaces them round the pivot pin 33 in response to the filling level.

The turning of the detection bars 34 is transmitted to the contact bar 37 by way of the link 35 so that the contact bar 37 is turned for displacement around the pin 36.

On the other hand, the binding device 27 has been pulled up to an upper position by the motion of the piston 44 of the air cylinder by way of the wire 39.

When the filled bag conveyed with the movement of the endless chain 30 arrives at a given position, the piston 44 of the air cylinder is released by detecting that arrival with a proper means.

Owing to the release of said piston 44, the wire 39 is pulled by the weight of the binding device 27, and it is moved, while sliding the sliding plate 40. When the sliding plate 40 is thus displaced, the contact 37 of the micro switch 42 fitted on the sliding plate 40 touches on the contact bar 37.

By this touch, the micro switch is cut off and the air supply of the air cylinder is broken, thereby to stop the movement of the piston 44 so that the descent of the binding device 27 is stopped and it is maintained at that position.

The position of the binding device 27 at the time when it has been thus stopped corresponds to the filling level of the bag detected by the filling level detection bars 34, and the bag is then bound at the position corresponding to the filling level.

When the binding is completed, the filled bag is carried on the conveyor for discharge by the conveyor 23.

After completion of the binding, the air cylinder is properly started up to pull up the binding device 27 by way of the wire 39 to the original position so that the binding device 27 gets into standby for the next binding operation.

The above-mentioned embodiment is so composed that the filling level detection bars 34 are provided separately from the binding device 27 to regulate the extent of descent of the binding device 27. However, the above arrangement is not restricted and another proper way may be adopted.

Figure 6:
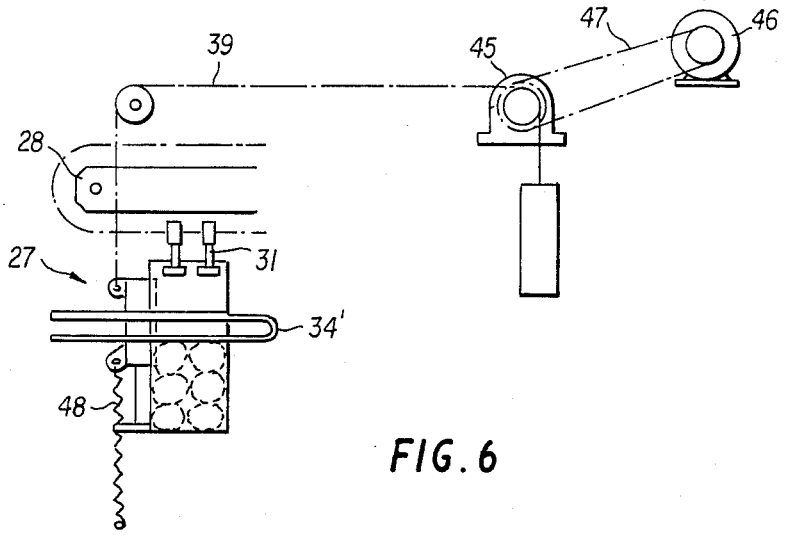
FIG. 6 is a view corresponding to FIG. 5 in the third embodiment.

As in the third embodiment shown in FIG. 6 for example, there may be adopted such an arrangement that filling level detection bars 34' are mounted on the binding device 27, and the descent of the binding device 27 is stopped at the position where the detection bars 34' touch on the fillings.

In the embodiment of FIG. 6, the binding device 27 is pulled by a spring 48 so as to be forced downwards, and the wire 39 is connected with a weight W by way of an electromagnetic clutch 45. The weight W acts as a balancer for making the binding device 27 drop smoothly by the tensile force of the spring 48, with no shock, when the electromagnetic clutch 45 is released, whereby the binding device is stopped at the position where the detection bars 34' touch on the fillings.

The reference numeral 46 is a motor, and the rotation of said motor 46 acts to rotate the electromagnetic clutch 45 by way of a belt 47 and to pull the wire 39 so that the binding device 27 is pulled up.

When the binding operation of the binding device 27 is completed, namely, the motor 46 is started up to pull the wire 39 and lift up the binding device 27, the electromagnetic clutch 45 is then actuated in the state that the binding device has been lifted up, thereby to restrict the movement of the wire 39 so that the binding device 27 is maintained at the lifted position.

When the filled bag has been conveyed to the binding position, the electromagnetic clutch 45 is released by detecting its arrival properly, thereby to drop the binding device. When the detection bars 34' mounted on the binding device 27 touch on the fillings in the bag, the binding device 27 is stopped at that position and the binding is thus carried out there.

Figure 7:
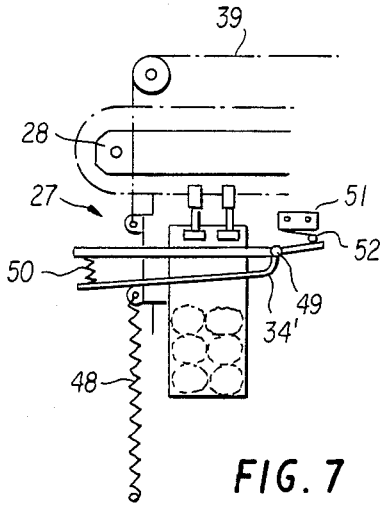
FIG. 7 and FIG. 8 are views corresponding to FIG. 5 and FIG. 6 in the fourth embodiment, respectively.
Figure 8:
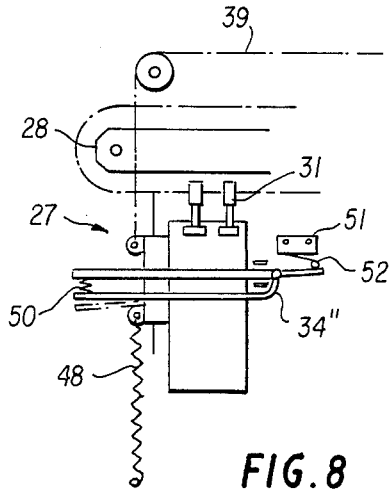

In the fourth embodiment shown in FIG. 7 and FIG. 8, detection bars 34'' are pivotally secured on the binding device 27 by a pin 49, and their fore ends are pushed down by a compression spring 50.

A limit switch 51 is arranged over the rear ends of the detection bars 34'', and the contactor 52 of said limit switch 51 is pressed down at the rear ends of the detection bars 34'' as shown in FIG. 7. The detection bars 34'' are forced downwards around the pivot pin 49 by the compression spring 50 as mentioned before. When the filled bag has been conveyed to the binding device 27, therefore, the restriction of the wire 39 is released by detecting its arrival, thereby to drop the binding device 27, and the detection bars 34'' touch the fillings so as to be turned clockwise round the pin 49 in response to the filling level of the bag.

When the detection bars 34'' have been turned to the state shown in FIG. 8, their rear ends are disengaged from the contact with the contactor 52 of the limit switch 50 so that the limit switch 50 is released.

By releasing the limit switch, the wire 39 is restricted to stop the descent of the binding device 27, and it stands still. Thus, the binding device 27 is caused to drop from the position where it is lifted in standby to the position corresponding to the filling level of the filled bag to be bound, and to stand still here, and it effects a desired binding.

In the above embodiments, there has been described such a system that fillings are put into a package bag, while it is being moved and the bag is further conveyed to the binding device. However, another system may be, of course, adopted in which articles are put into a package bag as it stands still, and the binding device is dropped down to that position to effect the binding.

Also in connection with the mechanism for lifting the binding device, the mechanism for holding the binding device at the position where it has been lifted, the mechanism for dropping the binding device, and the means for detecting the filling level of the fillings in the bag, there may be adopted various mechanisms and means other than those shown in the drawings.

In the present invention, it is essential in short that the binding device gets lifted except for the binding time, and the binding device is caused to drop to the position corresponding to the detected filling level of the filled bag when binding is effected. Owing to such a construction as mentioned above, there is no necessity for providing a complicated control mechanism required in such a case that the binding device is moved up and down in response to the filling level, to effect binding, and further there is no problem as to the responsiveness of a control device that is required for setting the vertical position of the binding device and stopping its vertical movement.

According to the present invention, as mentioned above, there are provided binding apparatuses which are simple in composition, but capable of effecting rapid binding of package bags at a desired position corresponding to the filling level, with accuracy.

Obviously, numerous modifications and variations of the present invention are possible in light of the above teachings. It is therefore to be understood that within the scope of the appended claims, the invention may be practiced otherwise than as specifically described herein.

What is claimed is:

1. A package bag binding apparatus for binding openings of package bags filled with packages, comprising:

a frame;

means supported by said frame for binding an opening of a package bag;

means supported by said frame for conveying package bags to said means for binding;

means supported by said frame for detecting a filling level of a package bag; and means responsive to said means for detecting, and operatively connected to said means for binding, for selectively vertically moving said means for bindng to a vertical filling position for filling a package bag having a detected filling level; and means operatively connected to said means for binding for lifting said means for binding to a lifted position and holding said means for binding in said lifted position, wherein said means for vertically moving comprise:

(a) means responsive to said means for detecting for releasing said means for binding from said lifted position, (b) means for lowering said means for binding, and (c) means for stopping said means for binding at said filling position.

2. The apparatus of claim 1, wherein said means for detecting comprise at least one bar pivotally mounted to said frame and inclined to a horizontal axis of said frame, said at least one bar being normally inclined into contact with bags conveyed on said means for conveying.

* * * * *